US006857483B1

(12) United States Patent
Dirks et al.

(10) Patent No.: US 6,857,483 B1
(45) Date of Patent: Feb. 22, 2005

(54) DRILLING DEVICE AND METHOD FOR DRILLING A WELL

(75) Inventors: Thorsten Dirks, Schüttorf (DE); Johannes Moss, Nordhorn (DE)

(73) Assignee: Bentec GmbH Drilling & Oilfield Systems, Bad Bentheim (DE)

( * ) Notice: Subject to any disclaimer, the term of this patent is extended or adjusted under 35 U.S.C. 154(b) by 0 days.

(21) Appl. No.: 09/763,086

(22) PCT Filed: Aug. 19, 1999

(86) PCT No.: PCT/DE99/02599

§ 371 (c)(1),
(2), (4) Date: Jul. 27, 2001

(87) PCT Pub. No.: WO00/11308

PCT Pub. Date: Mar. 2, 2000

(30) Foreign Application Priority Data

Aug. 19, 1998 (DE) ..... 198 37 692

(51) Int. Cl.[7] ..... E21B 19/00
(52) U.S. Cl. ..... 175/52; 166/77.51
(58) Field of Search ..... 166/77.51, 85.1, 166/377, 378, 380; 175/52; 414/22.51, 581, 590, 754.1, 801, 910

(56) References Cited

U.S. PATENT DOCUMENTS

| | | | | | |
|---|---|---|---|---|---|
| 3,734,208 | A | | 5/1973 | Otto | |
| 3,773,188 | A | | 11/1973 | Arrington | |
| 3,921,739 | A | * | 11/1975 | Rich et al. | 180/8.5 |
| 3,961,673 | A | | 6/1976 | Wolters et al. | |
| 4,020,953 | A | * | 5/1977 | Eklof et al. | 414/141.4 |
| 4,049,065 | A | | 9/1977 | Walter | |
| 4,128,135 | A | | 12/1978 | Mitchhart et al. | |
| 4,224,005 | A | * | 9/1980 | Dysarz | 405/196 |
| 4,578,911 | A | * | 4/1986 | Hashimoto | 52/120 |
| 4,605,077 | A | | 8/1986 | Boyadjieff | |
| 4,821,814 | A | | 4/1989 | Willis et al. | |
| 4,854,400 | A | | 8/1989 | Simpson | |
| 4,899,832 | A | | 2/1990 | Bierscheid, Jr. | |
| 5,018,588 | A | | 5/1991 | Haberer | |
| 5,492,436 | A | * | 2/1996 | Suksumake | 405/201 |
| 6,085,851 | A | | 7/2000 | Scott et al. | |
| 6,217,258 | B1 | | 4/2001 | Yamamoto et al. | |
| 6,361,262 | B1 | * | 3/2002 | Roodenburg | 414/22.51 |

FOREIGN PATENT DOCUMENTS

| | | | | |
|---|---|---|---|---|
| DE | 2 313 817 | | 9/1973 | |
| DE | 24 35 535 | | 6/1975 | |
| DE | 197 01 172 | A1 | 7/1998 | |
| EP | 0 243 210 | | 10/1987 | |
| EP | 0 272 850 | | 6/1988 | |
| EP | 0 379 187 | | 7/1990 | |
| GB | 2166176 | A * | 4/1986 | E21B/15/02 |

* cited by examiner

*Primary Examiner*—David Bagnell
*Assistant Examiner*—Daniel P Stephenson
(74) *Attorney, Agent, or Firm*—Cohen, Pontani, Lieberman & Pavane

(57) ABSTRACT

A drilling machine and drilling rig for exploratory drillings and producing wells, include a base mounting atop drive, and a multifunctional gripper for gripping drilling pipe from a stock and to be raised on the base for eventual positions positioning at a well center, an elevator being provided below the top drive. The base can be rotatably mounted and have a live ring at a base lower end region, the base being rotated to the pipe stock location and being rotatable to a well center as well. A drilling pipe upper end when raised on the base can be connected to the top drive, and an iron roughneck on a rig floor can be used to connect a pipe lower end to a pipe section in the well. Where two drilling machine are used, one can be used for actual drilling at the well center, and the second supplied with pipework for the operation.

14 Claims, 10 Drawing Sheets

DRILLING DEVICE AND METHOD FOR DRILLING A WELL

CROSS-REFERENCE TO RELATED APPLICATIONS

This is a U.S. national stage of application No. PCT/DE99/02599, filed on Aug. 19, 1999. Priority is claimed on that application and on the following application(s):

Country: Germany, Application No.: 198 37 692.8, Filed: Aug. 19, 1998.

BACKGROUND OF THE INVENTION

1. Field of the Invention

The invention relates to a drilling machine for a drilling rig and to a drilling rig which can be used for exploratory drillings and producing wells, especially in hydrocarbon deposits. This drilling machine can be used both onshore and offshore. The invention further relates to a method for sinking such a well.

2. Description of the Related Art

Modern drilling rigs according to the prior art consist of a large number of components, such as a drawworks, an iron roughneck, a rig floor, a pipe handling system, a pipe rack, a crown block with a traveling block and a top drive, and a pipe ramp and a catwalk for the drilling pipes and various auxiliary devices for handling.

Such drilling rigs have the disadvantage that they consist of a large number of components which, because of the constant changing of the drilling location of the drilling rigs, entail elaborate and costly logistics and large numbers of personnel. In addition, the individual components are not coordinated as regards their space requirement, so that a relatively large drilling area is needed which, however, is frequently not available (offshore) or very cost-intensive.

U.S. Pat. No. 5,018,588 describes a tie rod drill for the insertion of ground tie rods, such as are used in the civil engineering industry to secure embankments or pillar walls. The tie rod drill disclosed has a tracklaying gear on which a drill upper part is mounted by means of a live ring. Arranged on this upper part is a mast, to which a slide is fastened, on which in turn drill mount is mounted via a pivot device and a hydraulic cylinder. This drill mount consists of a supporting frame, a drill drive and two grippers, in which a drilling pipe can be retained.

The tie rod drill, like other tie rod drills (e.g. EP 0 379 187 A1) is suitable only for the placement of ground tie rods in the course of civil engineering work. These ground tie wells extend only a few meters deep into the ground or rock, and have only short pipe lengths of up to a maximum of 6 meters and pipe diameters up to a maximum of 176 mm (column 1, lines 62 to 64). For sinking exploratory and productive wells, as needed for example in the oil and natural gas industry, such tie rod drills are completely unsuitable.

SUMMARY OF THE INVENTION

It is an object of the present invention to propose a drilling machine for exploratory and productive wells, a drilling rig and a method whereby decisive cost savings can be achieved with regard to logistical and personnel costs.

The drilling machine for exploratory and productive wells according to the invention comprises a base, on or in which, by means of a guide, a top drive displaceable relative to the longitudinal axis of the base and a multifunctional gripper, which is movable perpendicularly relative to the base and both guides and grips the drilling pipe, are arranged, the base itself being rigid and preferably pivotably and/or rotatably mounted. An intermediate piece or a live ring is connected to the base, the intermediate piece or live ring being arranged directly at the foot of the base.

The advantages achieved by means of the invention reside especially in the fact that a drilling machine is provided which is unusually economical of space and can handle the pipe automatically. Advantageously, the live ring connected to the base, or the intermediate piece, absorbs the forces acting on the base.

The top drive comprises the actual drive, in order to rotate the pipe, and a handling device which connects the pipe to the drive shaft of the actual drive. This handling device is located below the actual top drive. Optionally, a screwing and securing device is arranged on the top drive.

In addition, an elevator is arranged below the top drive and the handling unit and serves to lift the pipe from the vertical position.

The top drive is arranged on the receiving frame which is connected to the drawworks, for example by means of a cable, which can also be multiply rove. The receiving frame is moved, for example by means of guide rollers in a linear guide, parallel to the longitudinal axis of the base. The linear guide may be connected to the base both externally and internally;

The top drive is designed to be displaceable with the receiving frame in the linear guide. The receiving frame for the top guide may be arranged in or on the base. The guide may, for example, be secured by a sliding rail and sliders and by racks and pinions or guide rollers and guide rails. Possible linear drives include, in addition to rack drives, spindle drives, hydraulic drives and a plurality of chain hoists. However, other linear drives resulting from technological progress could also be installed. Another possibility is a cable hoist or a block and tackle combination with a drawworks, a traveling block, a dead cable anchor, a reverse cable drum and a crown block (bearing).

Preferably, the base is formed in a box structure, for example, if it is pivotable, in a type of rocker. The foot of the base can be mounted on, in, or below the rig floor. Another possibility is for the base, including the foot, to be installed on a supporting vehicle, such as, for example, a mobile workover rig.

The ground, in other words the surface of the terrain, may also be used as a rig floor. In a particular embodiment of the invention, the rig floor of the drilling machine is connected to a subframe, which may consist of subframe boxes and/or subframe supports or other standard solutions (slingshot, etc.).

In a particularly advantageous development of the invention, the live ring of the drilling machine according to the invention has a through guide through which a cable is guided which connects the top drive via a crown block to the drawworks. Preferably, the through guide is arranged at the center of the intermediate piece or live ring, in order to ensure optimum cable guidance during the operation of the drilling machine.

A further embodiment envisages that an iron roughneck is arranged in the lower region of the base, just above the rig floor, and is used for securing and breaking.

The iron roughneck may be arranged pivotably and/or movably on the base. An alternative possibility is for the iron roughneck to be arranged movably or pivotably on the rig floor.

Advantageously, a retaining apparatus is fixed below or on the rig floor, for example in order to catch the drilling pipe or the casings.

The drilling machine may also be displaceable in a further embodiment. By displacement from the well center, the well head can be made accessible, so as to facilitate in particular the installation and removal of heavy preventers. The possibility also exists of moving the vertically standing drilling machine out of the region of the well and steering it, for example, into the region of pipe racks in order to pick up pipes. In addition, advantageously, the drilling machine can be adjusted relative to the center line. Furthermore, pipes can be taken from a plurality of pipe racks arranged side by side and, for example, positioned vertically. Moreover, this advantageous embodiment creates the possibility of moving the drilling machine from well to well among cluster wells, for example offshore.

The bases are freestanding, which means that no additional steel structure has to be fixed on the rig floor in order to stabilize the bases. However, the possibility does also exist of installing a steel structure, for example on the rig floor, as a result of which a lightweight construction of the base is permitted, since such an additional structure would increase rigidity and achieve high flexural strength. The principal forces can be passed into such a steel structure.

In such a case, a holding apparatus, preferably a locking unit, would be arranged in the upper region of this additional steel structure and would hold both a pivotable and a rotatable base in a defined position. This locking device can be in the form of a hollow cylinder, to which a flushing hose is connected and on which a valve is arranged in order to ensure the flushing feed. The flushing is fed to the flushing hose via an ascending pipe arranged on or in the base or on the additional steel structure. Especially if the base is pivoted, it is advantageous to incorporate the flushing feed into the locking device, so that flushing is available virtually automatically and without a further working step.

As a result of the linear movement of the top drive, flexible lines must be provided for flushing, energy and the control of the ascending line to the top drive. This can be ensured, for example, by a drum arranged in the upper region of the base which, during a downward movement, unrolls the flushing hose and, during an upward movement, winds it up again so that the risk of breakage or other damage during installation and removal of pipes is avoided.

In a preferred embodiment, the top drive is arranged to be rotatable about a parallel axis of the base. As a result, only part of the drilling machine and hence a reduced load needs to be moved in order to receive a pipe. In addition, the live ring can be dispensed with. For example, the top drive is articulated by means of a hinge on a long side of the receiving frame and locked in the unrotated position, as for example during the drilling operation. The locking is released at the start of the rotating operation. The rotational movement is preferably performed by means of a hydraulic cylinder or by one or more stepping motors.

A further embodiment envisages arranging a freely suspended flushing hose on the freestanding base or on the additional steel structure.

In order to erect the supporting structure from the horizontal into the vertical position, a lifting apparatus is provided which comprises one or more hydraulic or pneumatic cylinders. Instead of a cylinder, a winch may also be used. This makes drilling possible at an angle of from 5 to 90 degrees to the surface of the terrain. Erection can also be performed in sections, with the aid of a crane, if no cylinder or winch is installed.

A particularly advantageous embodiment envisages that a winch is arranged in the lower region of the base, its cable being secured via a return roller to the receiving frame on which the top drive is located. Above the winch is the fixed roller of the cable hoist. This winch is driven by means of a drive unit, preferably comprising an electric motor with downstream transmission. Further drives, for example a hydraulic drive, are possible. As a result of this arrangement, the movement of the receiving frame and hence of the top drive in or on the base is possible, especially if little or no load has to be moved. As a result of this arrangement, the top drive can be drawn downward, in other words a compressive force toward the ground is generated.

This has the advantage that workover tasks, drilling operations and snubbing operations (e.g. pipe installation) can be carried out or initial pressure exerted at the start of drilling.

A preferred embodiment of the invention envisages that means for pivoting the base are arranged on the rig floor of the drilling machine, these means preferably comprising a pivot bearing with a bolt and a connecting member to the base, together with a lifting apparatus, if installation is not to make use of a crane.

Suitable alternative apparatuses for erecting the base include, in particular, pneumatically or hydraulically operated lifting apparatuses or winches.

A drilling machine of this design is able to sink wells at different angles or, especially with smaller drilling machines, to receive the pipe independently and actively without the need for any special pipe handling device.

A further advantageous development of the invention envisages that an independent handling device is arranged adjacent to and/or below the rig floor or adjacent to the base, and preferably comprises a truck which is arranged to be movable on rails. Arranged on the truck is a boom unit which is advantageously mounted to be rotatable and/or pivotable by means of a pivot device in a vertical plane and comprises a pipe receiving unit and/or at least one holding unit, preferably a gripper.

The pipe handling device allows the drilling machine to be automatically supplied with pipe in a rapid and reliable manner, especially since the pipe handling device is able to take pipes from various pipe racks, especially pipe boxes, and feed them to the drilling machine. Such an embodiment is very particularly advantageous in conjunction with a drilling rig which comprises at least two drilling machines, in which case one pipe handling device can be dispensed with.

The text that follows provides details of a specific embodiment of the invention.

The drawworks is installed in one of the subframe boxes. The reserve cable drum can also be accommodated in one of these boxes. The crown block is fixed in the upper region of the base.

The cable is passed through the intermediate piece of the base in order not to interfere with the possible subsequent rotatability of the base and to avoid damage to the cable if a live ring is retrofitted. Above the drawworks is a trolley which assists the introduction of the cable through the intermediate piece into the fulcrum of the base. By means of this arrangement, the cable is only slightly twisted and not exposed to additional stresses if a live ring is subsequently installed, for example in conjunction with a second drilling machine. A further advantage of this design is the extremely low center of gravity of such a drilling machine.

A further embodiment envisages installing a small winch in the lower region of the base in order also to pull down the receiving frame of the top drive, especially if the installation of a drawworks as a linear drive is intended. The cable of this small winch is fixed to the lower part of the receiving frame or guided downward over a return roller fixed on the receiving frame and secured. By means of this winch, workover tasks, drilling operations and also snubbing operations (or pipe installation) can be performed more simply.

A further embodiment envisages that a pipe rack is arranged adjacent to the drilling machine, and is arranged vertically for the rotatable version and horizontally for the pivotable version.

In the case of the vertical version, for example, the pipe racks stand to the right and left of and adjacent to a rail-borne pipe handling system. The pipe handling system takes the pipe from the vertical pipe racks and conveys it to a defined and fixed collection position.

A further possibility envisages that the iron roughneck is displaceable perpendicularly to the base and/or can be run into the base. The advantage of such a design resides in the fact that the downhole equipment can be introduced into the well without problems.

Also described is a drilling rig, which is characterized in that two or more drilling machines are arranged to be alternately movable or rotatable or pivotable over the well center. The advantage of such a design resides in the fact that one drilling machine performs the actual drilling operation and the other is supplied with a pipework for that operation. As a result of this the drilling time is reduced and cost-effectiveness optimized.

Preferably, the drilling rigs are arranged substantially in exact symmetry relative to the center of the well.

Since a drilling machine which is loading a pipe is not located over the well center, the other drilling machine can connect the previously loaded pipe to the pipe drain in the well and continue sinking the well. This creates the possibility of sinking the well virtually continuously. A further advantage lies in the fact that the drilling rig can be operated with a minimum of drilling-personnel, as it performs these operations almost completely automatically, especially in the handling of the pipes, etc.

Particularly when a steel structure is used, the two bases or drilling machines can advantageously be connected, preferably by means of a cable, a chain or a kinematic chain, in order to minimize the energy necessary in the pivotable version of the bases. The connection of the two supporting units is ensured via a return point, for example a roller, which is arranged in the upper region of the steel structure. With such an arrangement, the energy of the distributing supporting unit can be utilized to erect the other supporting unit. In such an embodiment, preferably, a damping device is installed on the upper steel structure in order to avoid possible resonance vibrations which may be passed into the drilling rig. Such a damping unit could, for example, comprise a spring or a hydraulic cylinder with choke.

The method according to the invention is characterized in that, in the pivotable version, the base is available in the horizontal position to receive the pipes.

The top drive is in the upper position and the multifunctional gripper at the same height as the pipes, for example, lie on the stands. The pipe is rolled over the base. Then, in the lying position, the pipe is gripped by the multifunctional gripper and thus locked. Subsequently, by means of the top drive and the handling device, which is located between the top drive and a lower region of the base, the upper connection to the pipe is produced. Subsequently, the base is raised into the vertical position by means of the lifting apparatus and the lower connection between the pipe on the base and the pipe located in the well is made. Optionally, when this position is reached, the base can be locked on a steel structure.

As already mentioned, the possibility exists of the base being freestanding, in which case locking or the retention of the base takes place in the region of the fulcrum or pivot point.

The connection between the top drive shaft and pipe is produced, in particular, when pipes are set down during drilling. During handling pipe steps involved in installation and removal operations, the pipe can also be merely suspended in the elevator which is arranged below the top drive, since the thread of the pipe is particularly protected from damage and the operations can be performed more quickly.

The lower pipe connection is ensured by the iron roughneck, standing on the rig floor or integrated on the base, which, to this end, either moves out from the base beyond the well center or is pivoted over the well center by means of a hinge. A further embodiment envisages that the iron roughneck is arranged conventionally in a displaceable manner on the rig floor. Similarly, after the screw connection between the pipe in the well and that in the drilling machine is complete, the multifunctional gripper is released and run into the base.

The iron roughneck is then maneuvered out of the area, the holding apparatus is released and the drilling operation continues. To this end, the top drive is lowered in the guide of the base.

As a result of the use of two pivotable drilling machines, the advantageous possibility exists of a drilling machine located in the horizontal position picking up the pipe, while the other drilling machine drills. As soon as the vertically standing drilling machine has completed the drilling operation, and the top drive has thus arrived in the lower position, the horizontally lying drilling machine can be raised into the vertical position by means of the lifting apparatus. When this occurs, the top drive, in the case of the distributing drilling machine, is moved back into the upper position during this movement.

A further advantageous embodiment of the method according to the invention is illustrated by means of a rigid base. The pipe is removed from the pipe rack by means of the rail-borne pipe handling system and moved toward the rig floor. The top drive is located in the upper position.

The pipe handling device inclines the pipe toward the base, and the top drive and the elevator, and also the handling system, are lowered to a level at which the elevator can encompass the pipe. When this level is reached, the elevator encompasses the pipe. Simultaneously, the multifunctional gripper moves out from the base and encompasses the pipe, so that the latter is fixed in its position but can be displaced in the vertical direction.

Subsequently, the pipe, suspended in the elevator, is raised by the linear drive, the multifunctional gripper guiding and controlling the pipe in the lower region and running it into the base in accordance with the travel covered in the linear guide. As soon as the top drive has arrived in the upper position, the upper connection between drive shaft and pipe is brought about with the aid of the handling device or by a screwing and securing device. Subsequently, the pipe is lowered and the connection to the pipe located in the well is brought about by means of the iron roughneck. The multifunctional gripper is then run in, the holding apparatus is released and the drilling operation is continued. Alternatively, the pipe, suspended in the elevator, can initially be screwed to the pipe located in the well and only subsequently connected to the top drive by means of the handling device or a screwing and securing device located on the top drive.

Another method step envisages that the pipe is conveyed by means of the rail-borne pipe handling device to the defined collection point. The base rotates about its own longitudinal axis with the aid of the built-in live ring and stops precisely above the collection point. At this time, the top drive is located in the upper position of the base. Alternatively, in a rigid drilling machine, it is possible for only the top drive to be pivoted or rotated from the receiving frame to a defined collection point.

The top drive, and hence also the handling device and the elevator, are now lowered. The elevator is pivoted outwards during lowering. As soon as the elevator can encompass the pipe, the latter is pivoted in and encompasses the pipe.

The multifunctional gripper is run out from the base and likewise encompasses the pipe. This serves to retain the pipe at two points and avoid shaking in the event of further handling. Subsequently, the pipe is raised parallel to the linear guide by means of the upward-moving elevator until the top drive has reached the upper position. The base is then pivoted over the well center.

The upper connection between drive shaft and pipe by means of a screwing and securing device or with the aid of the handling device can take place during this lifting and rotational movement in order to optimize overall times.

Subsequently, the lower connection is made with the aid of the iron roughneck and the iron roughneck is subsequently maneuvered once again out of the region of the well center.

The multifunctional gripper is run into the base, the holding apparatus is released and the drilling operation is continued.

If two or more drilling machines are used, one drilling machine can receive a new pipe and the others drill, so that almost continuous drilling is guaranteed. Steps are taken here by means of appropriate control to prevent the rotating drilling machines from colliding. When pipes are being installed and removed (round trips), screwing to the drive shaft it of the top drive is normally not necessary.

Instead of pipes, individual drilling train sections, casings, pipe strings, tubing or pipe-like articles may be used.

Examples of embodiments of the rigid version with one drilling machine and a rail-borne pipe handling system and the rotatable version with two drilling machines and pipe handling system (e.g., a vertical pipe handler/horizontal pipe handler) are explained hereinafter.

DESCRIPTION OF THE PRESENTLY PREFERRED EMBODIMENTS

Figure 1:
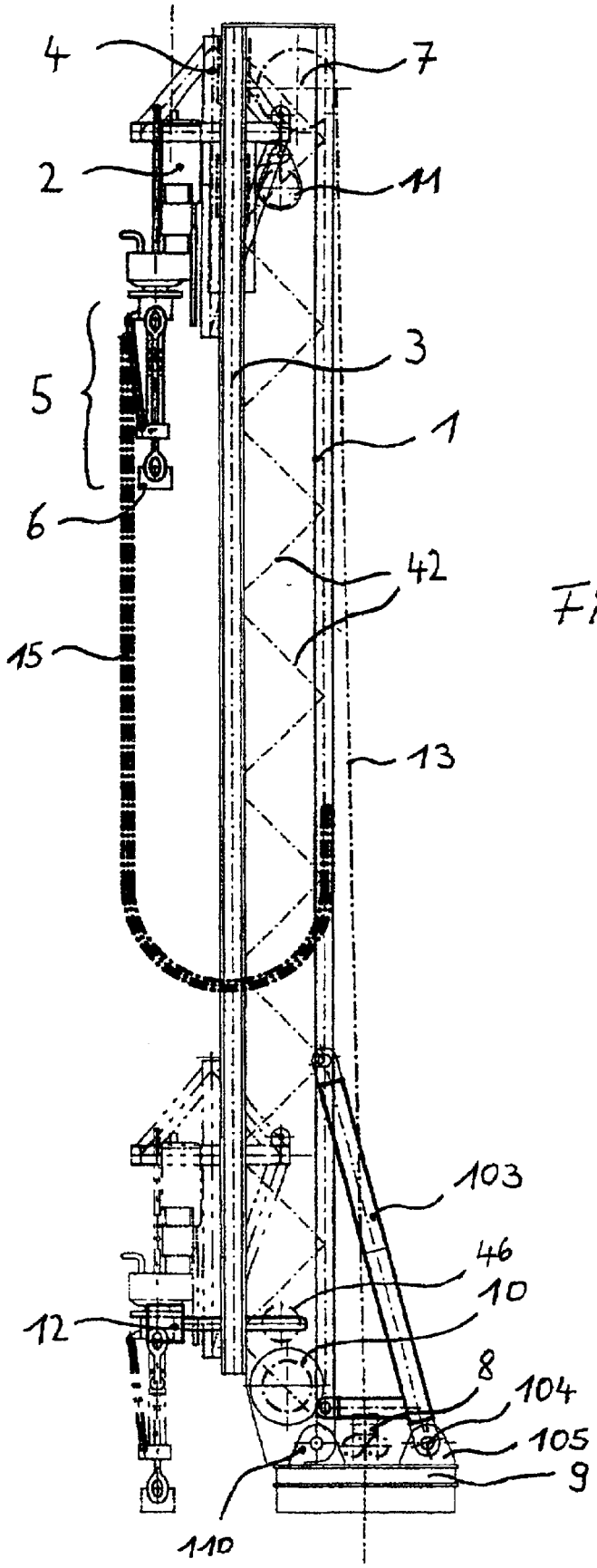
FIG. 1 shows the lateral view of the base.

In FIGS. 1, 2, 4, 5, 6, 8, 9 and 10, the receiving frame 4 with top drive 2 and handling device 5 or the pipe handling device 23 are shown in two different positions, one position in each case being shown in broken lines. In the broken-line illustration of the receiving frame and the top drive, the return roller 11 is not shown.

FIG. 1 shows the lateral view of the base 1 with the top drive 2, the linear guide 3 attached to the base, the receiving frame 4 for the top drive, the handling device below the top drive 5 and the elevator for pipe acceptance. Below the top drive is optionally arranged a screwing and securing device, in order to screw a pipe feef in by means of the handling device fixedly to the shaft of the top drive, or, for example during the removal of the pipe, to break the connection again between top drive and pipe. Struts 42 of the base 1 are indicated, these improving the statics of the base.

Also shown in the drawing is the crown block 7, which is integrated in the upper region of the base. The cable 13 is guided through the live ring 9 by means of the through guide 8, in order that the position of the cable should not change during the rotational movement.

The live ring 9 is mounted below the base 1 and is fixedly connected to the rig floor.

In order to perform snubbing operations, including for example the installation of pipes, a winch 10 is installed in the lower region of the base 1. The cable (not shown) of this winch is, in this case, passed over a return roller 11 in order to utilize the cable hoist effect.

The multifunctional gripper 12 is shown in the drawing as a further structural group, this gripping and guiding the pipe and being horizontally displaceable.

In order to enable the flushing feed, the flushing hose 15 is indicated and, in this example, hangs partly free.

Arranged on the live ring is a connecting member 105 on which a rigid retaining member, in this case a strut 103, is attached by means of pillow blocks 104 and bolts. The other end of the strut 103 is fixedly connected to one side of the base 1. A further connecting member 110 contains a further pillow block 104 and provides a connection to the base 1 by means of a bolt. As a result, the entire base can be held vertically. Other connecting members whereby the base 1 can be held are of course conceivable.

Figure 2:
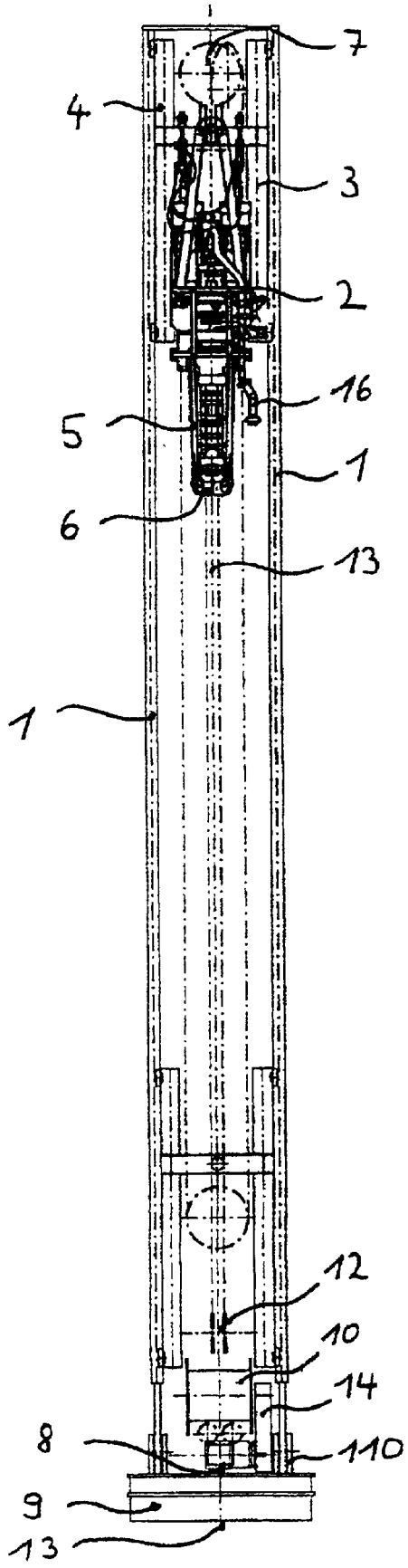
FIG. 2 shows the front view of a base.

FIG. 2 shows the frontal view of the base 1 with the top drive 2, the receiving frame 4, the handling device 5 and the elevator 6.

The crown block 7 is additionally indicated here. At the center of the base 1 can be seen the cable 13, which is passed by the through guide 8 through the live ring 9 in the lower region.

The flushing hose (shown in FIG. 1 but not here) is connected to the pipe connection 16 in order to pass the flushing into the top drive.

For snubbing or pipe installation, the winch 10 is mounted in the lower part of the base 1 and is driven, for example, by an electric motor with downstream transmission (drive unit 14).

Figure 3:
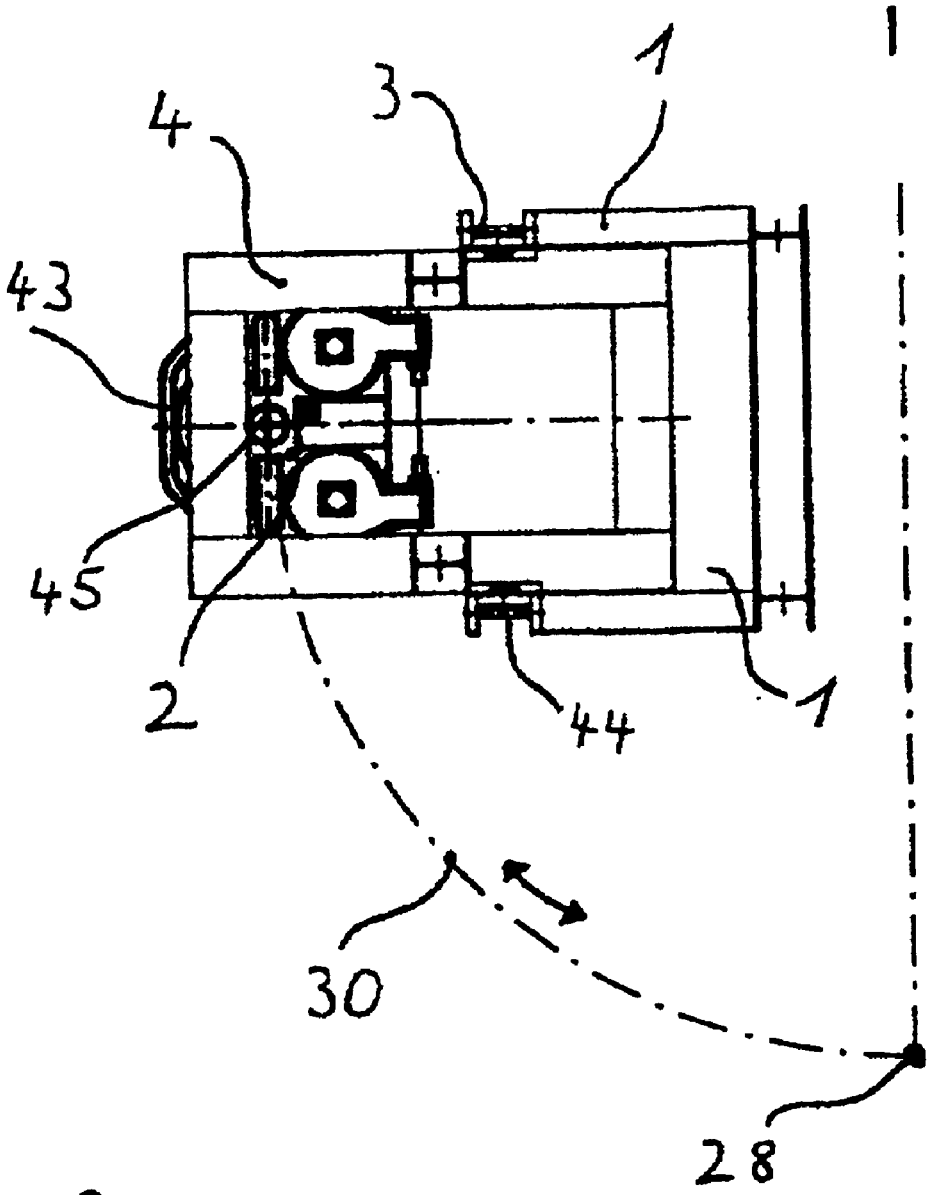
FIG. 3 shows on enlarged scale the plan view of the upper part of a rotatable base.

FIG. 3 shows the plan view of a rotatable base 1 with the linear guide 3, in which the receiving frame 4 is guided by means of guide rollers with the top drive 2 mounted thereon.

The quarter-circular broken line represents the pivot line 30 for this arrangement as far as a fictitious collection point 28. The drive shaft 45 is only indicated, as is the lining 43 of the top drive.

Figure 4:
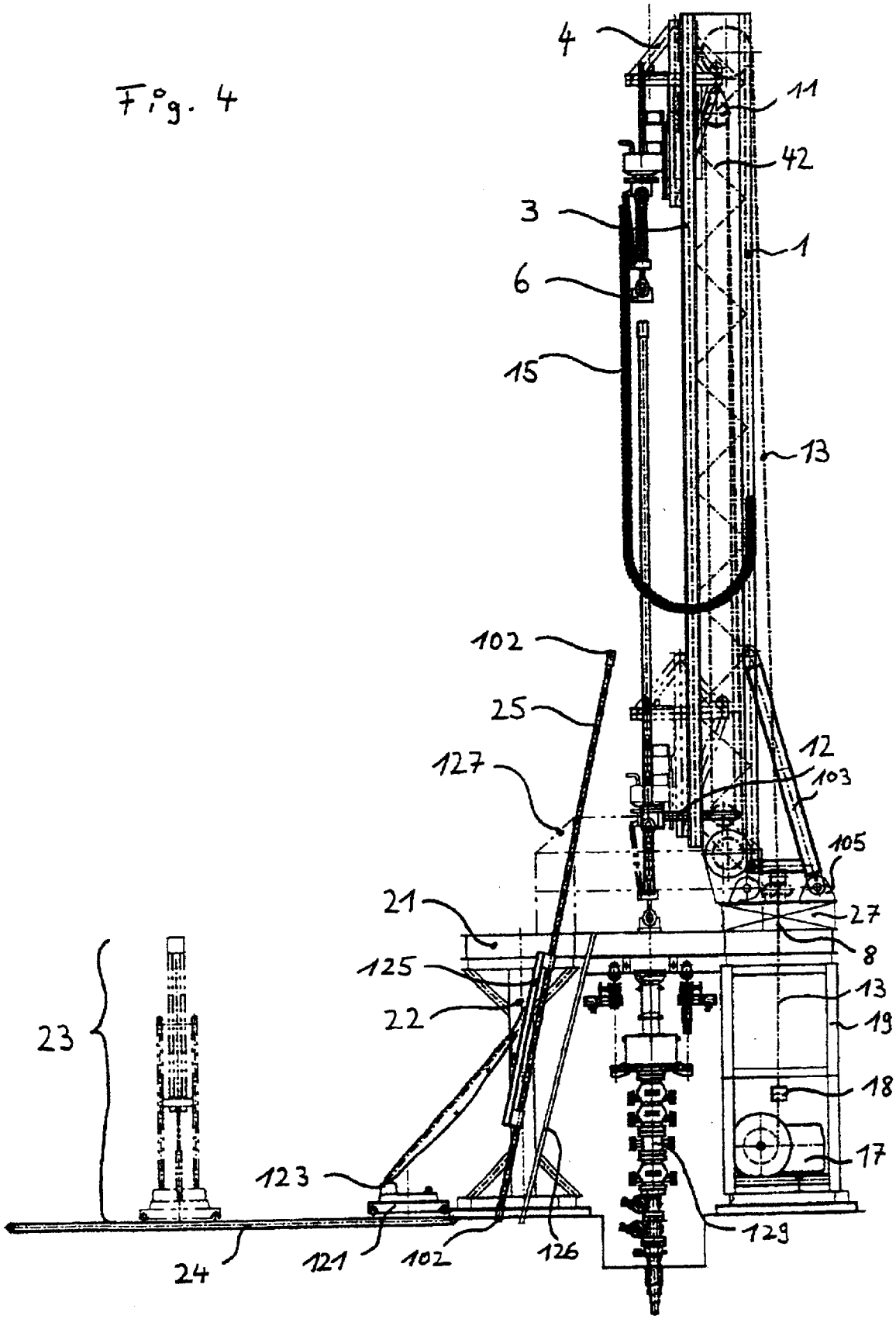
FIG. 4 shows the lateral view of a drilling machine with a base (rigid) arrangement.

FIG. 4 shows the lateral view of the drilling machine with a base according to FIG. 1.

In this version of a non-rotatable drilling machine, the live ring is not needed. However, in order to enable rigging to take place in a simple manner, an intermediate piece 27 replacing the live ring is used, preferably having the same dimensions and connecting measures as the actual live ring, and similarly containing the through guide 8.

To this end, the rig floor 21, which serves to receive the intermediate piece 27 and also the subframe boxes 19 and the support 22, which serves to support the rig floor, are drawn in.

In addition, the drawworks 17, which can be installed in either the upper or the lower subframe box, is shown.

The cable 13 is always forcibly guided over the Lebus groove of the drawworks drum with the aid of the trolley 18.

The feeding in and collection of pipes takes place by means of the preferably rail-borne pipe handling device 23, which can be moved on the rails 24 and transports and adjusts the pipe 25.

Also shown are the transverse struts 42, which improve the statics of the box structure of the base 1. A closed box structure may also be used instead of this lattice structure.

The pipe is removed from a pipe rack (not shown) by means of the pipe handling device 23 and passed via the rails 24 to the drilling machine. The pipe 25 is fed by means of a gripper 125 to the pipe receiving unit 122 until it can be encompassed by the elevator 6, which moves downward into the appropriate position. The pipe ramp 126 is optionally provided to secure the lower part of the pipe. A pivot device by which the boom 124 can be moved into a vertical plane is designated 123. The blow-out preventer (BOP) stack, above the well (not shown), is designated 129.

Figure 5:
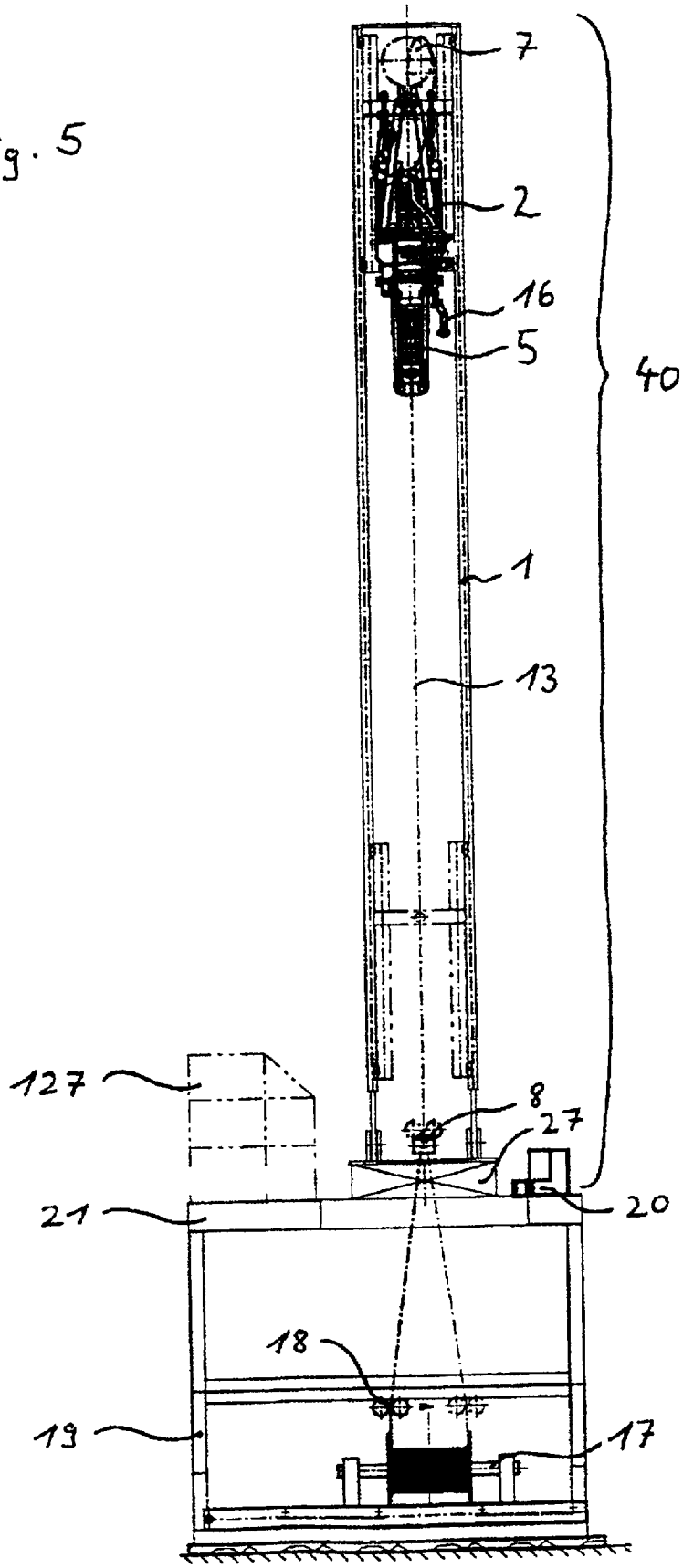
FIG. 5 shows the front view of the drilling rig.

FIG. 5 shows the frontal view of the drilling rig with the base 1 corresponding to FIG. 2, the live ring 9 having been replaced by an intermediate piece 27.

This view shows, by way of example, the iron roughneck 20, which has been mounted in this form on the rig floor 21. Also shown is the top drive 2 with the handling device 5 lying below it.

The cable 13 is always forcibly guided over the Lebus groove of the drawworks 17 by means of the trolley 18, so that the cable 13 is reliably passed from this device through the through guide 8 to the crown block 7.

The base 1 is connected by the intermediate piece 27 to the rig floor 21. A driller's cabin 127 arranged on the rig floor 21 is also indicated therein.

Figure 6:
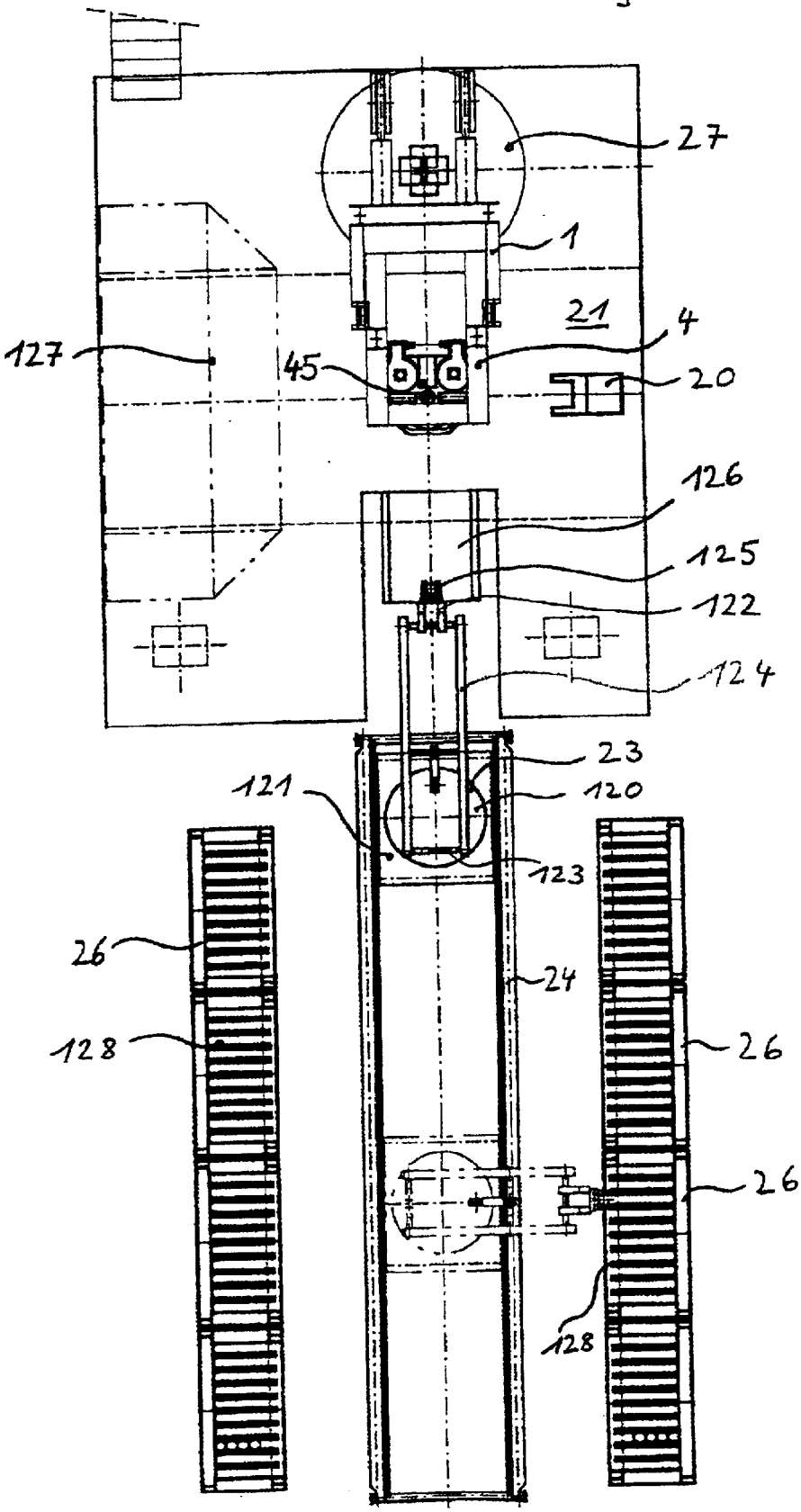
FIG. 6 shows the plan view of a rigid drilling machine.

FIG. 6 shows the plan view of the rigid drilling machine on the rig floor 21. In the plan view, the lateral arrangement of the iron roughneck 20 is identifiable. The pipes are removed from the vertically standing pipe boxes 26 by the rail-borne pipe handling system 23, which runs on the rails 24, and passed to the drilling machine. Any desired storage capacity can be achieved by this arrangement of the vertical pipe boxes 26.

Figure 7:
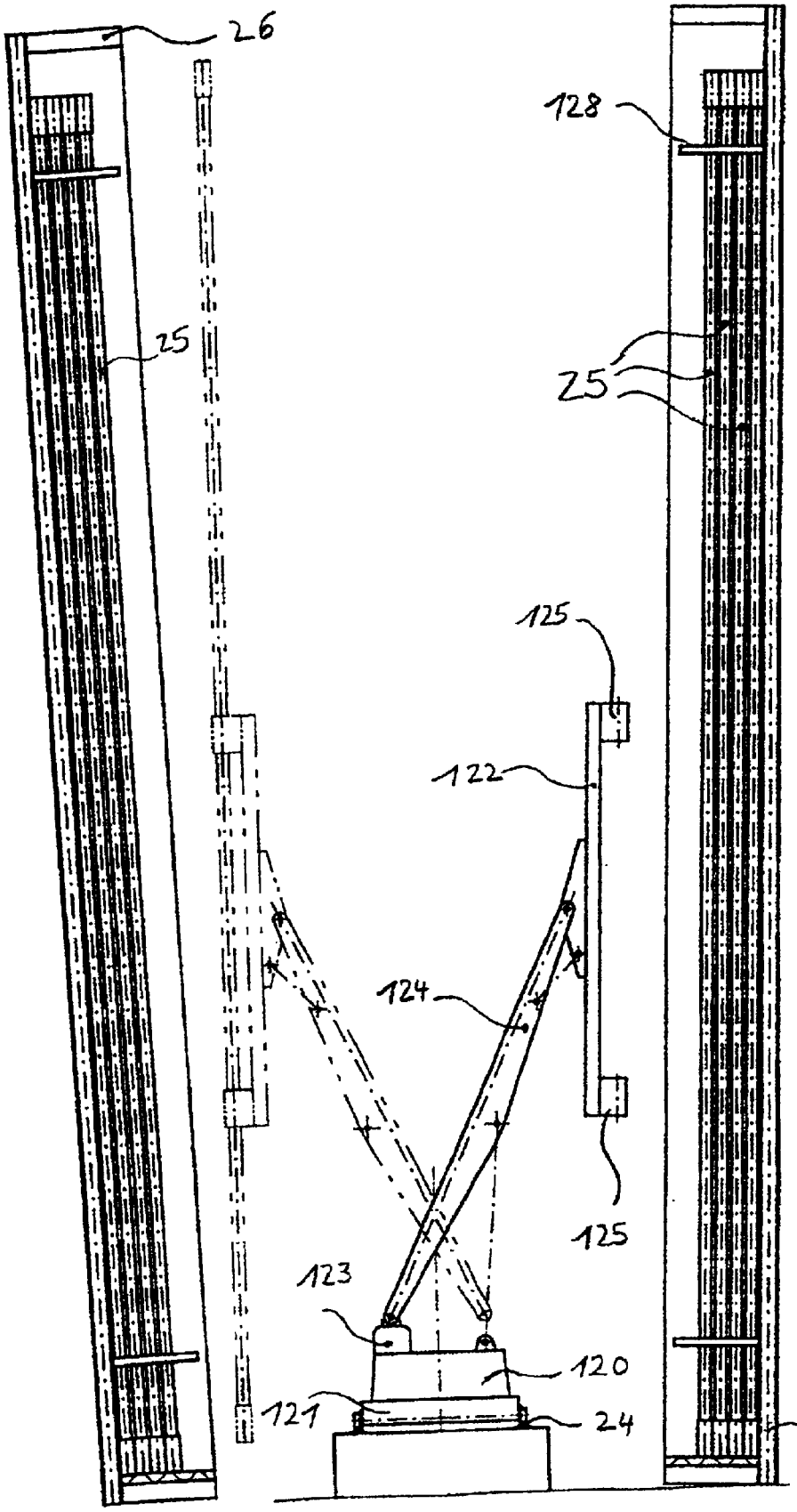
FIG. 7 shows a rail-borne pipe handling device (for horizontal or vertical racks)

FIG. 7 shows the rail-borne handling device 23. The possibility exists of storing a stock of pipes 25 in vertically standing (or horizontally) lying pipe boxes 26 and removing them therefrom.

The pipes 25 are guided or fixed during transport, or during loading or unloading from the pipe boxes, by fingers or transport mountings 128. In this example of embodiment, the individual pipes 25 are removed from the boxes 26 by means of the pipe handling device 23. The pipe receiving unit 122, with two grippers 125 in this example, which can pivot in a vertical plane as a result of the pivot apparatus 123, is guided to the pipe 25 and the pipe 25 is gripped. Thereafter, the boom 124 is pivoted back. In this example, the truck 121 is moved on the rails 24 toward the drilling rig (not shown). In addition, a rotating apparatus 120 is provided whereby the boom 124 with the pipe receiving unit 122 can be rotated on the truck 121, for example in order to reach a particular collection point 28. Not illustrated is the possibility of designing the pipe receiving unit 122 to be displaceable, so that short lifting movements are possible in order to make it easier to remove the pipe 25 from the transport mounting.

Figure 8:
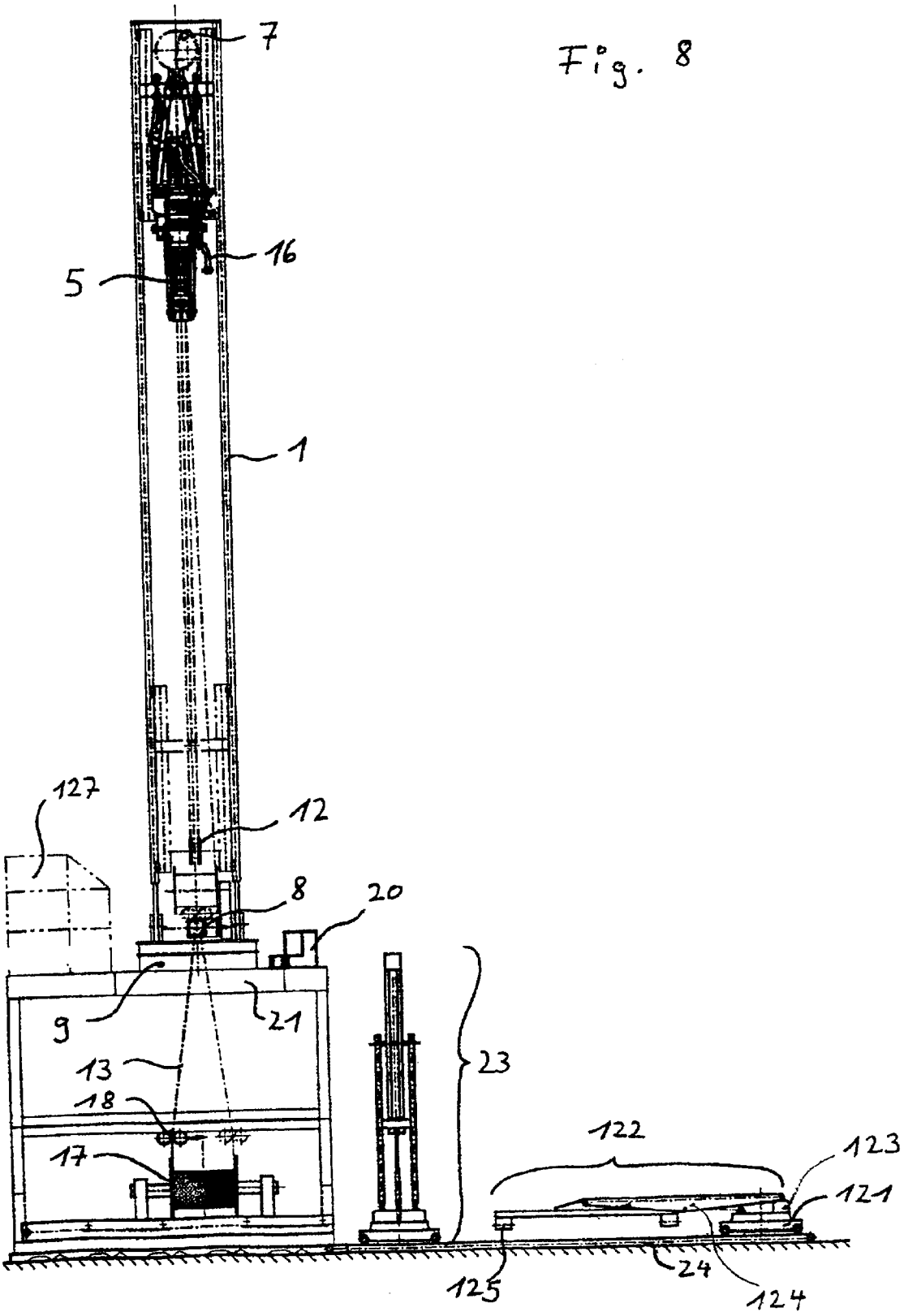
FIG. 8 shows a frontal view of a drilling machine and a pipe handling device and a pipe receiving unit disposed alongside the drilling rig.

FIG. 8 shows the frontal view of the drilling rig in section, with two bases 1 and the associated components, as shown in FIG. 2, one of the bases not being shown as a result of the section. This drilling rig is equipped, in this embodiment, with one live ring 9 in each case, below the base 1, in order to pivot the drilling machine alternately over the well center.

In addition, the rail-borne pipe handling system 23 with the rails 24 is shown, this transporting the pipes to the respective collection points.

Figure 9:
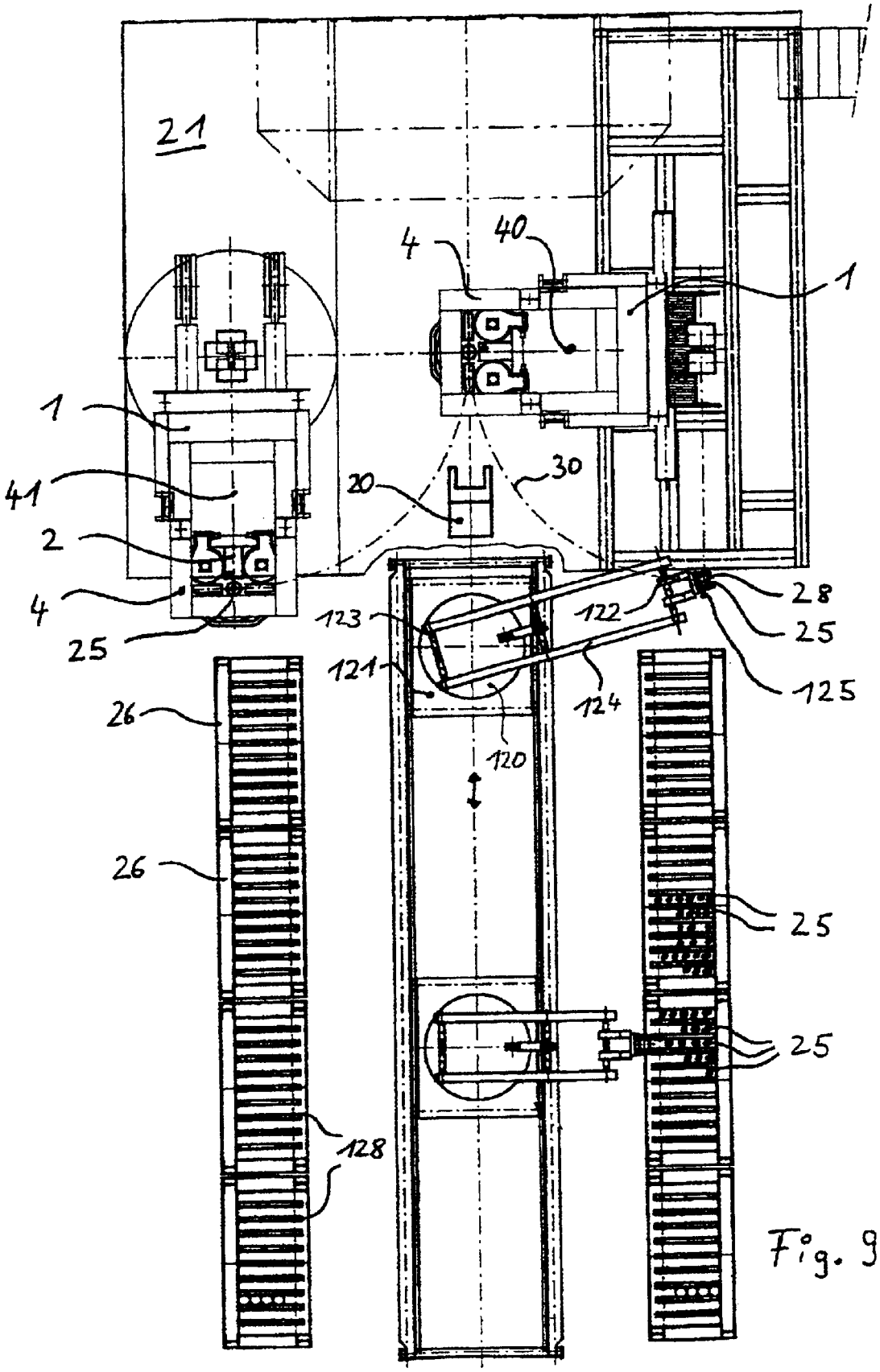
FIG. 9 shows the plan view of a drilling rig with two drilling machines.

FIG. 9 shows the plan view of the drilling rig according to the invention with two drilling machines 40.

In this view, one drilling machine 40 is pivoted inward over the well center 130 and is just ending the drilling process and the other drilling machine 41 is pivoted outward and stands ready, with pipe 25 loaded, to pivot over the well center 130. The iron roughneck 20 is arranged centrally, in order advantageously to break or make up the connections.

Similarly, the rail-borne pipe handling device 23 with the rails 24 is shown, as are the pipe boxes 26.

The pipes 25 are transported to the collection points 28 and taken over by the handling device 5 (not shown) with the elevator 6 (not shown) lying below it.

Figure 10:
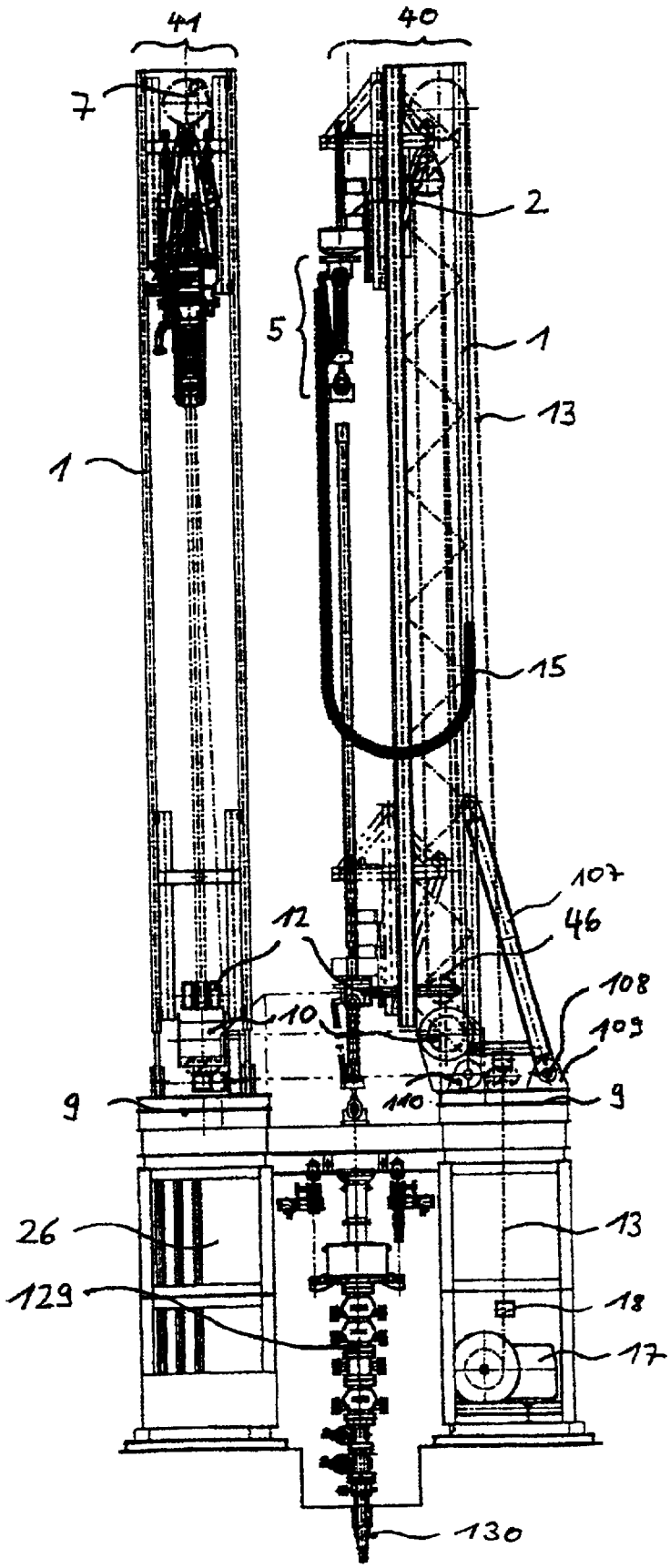
FIG. 10 shows a lateral view with two drilling machines with live rings.

FIG. 10 shows the lateral view with the twin drilling machines 40, 41 according to FIG. 1 (pivoted outward, 41) and FIG. 2 (pivoted inward, 40) which are fixed on the two live rings 9 on the rig floor 21.

This design of the drilling rig possesses two drawworks 17 and also two cables 13, FIG. 10 showing only the drawworks and cable 13 of the drilling machine 40.

In this example of embodiment, the drilling machine 40 is shown diagramatically as being optionally pivotable from the vertical into the horizontal position, 107 designating the lifting apparatus, 108 the pivot bearing and 109 the connecting member.

As a result of the doubling of the drilling machines, the possibility now exists of drilling with one machine and reloading the pipe with the other machine. As a result, the well can be sunk more quickly.

List of References

1 Base
2 Top drive
3 Linear guide
4 Receiving frame
5 Handling device
6 Elevator
7 Crown block
8 Through guide
9 Live ring

10 Winch
11 Return roller
12 Multifunctional gripper
13 Cable
14 Drive unit
15 Flushing hose
16 Pipe connection
17 Drawworks
19 Subframe boxes
20 Iron roughneck
21 Rig floor
22 Support
23 Pipe handling device
24 Rails
25 Pipe
26 Pipe boxes
27 Intermediate piece
28 Collection point
30 Pivot line
40 Drilling machine
41 Further drilling machine
42 Struts of the base
43 Lining of the top drive 2
44 Guide rollers in the linear guide 3
45 Drive shaft of the top drive 2
46 Fixed roller of the cable hoist, which is connected via a cable and the return roller 11 to the winch 10
102 Pipe connector
103 Rigid retaining member
104 Pillow block with bolt
105 Connecting member between retaining member 103 and live ring 9 or intermediate piece 27
107 Lifting apparatus
108 Pivot bearing with bolt
109 Connecting member between lifting apparatus 107 and live ring 9 or intermediate piece 27
110 Connecting member between base 1 and live ring 9 or intermediate piece 27
120 Rotating apparatus
121 Truck of the pipe handling device 23
122 Pipe receiving unit
123 Pivot apparatus
124 Boom of the pipe handling device 23
125 Gripper of the pipe receiving unit 122
126 Pipe ramp
127 Driller's cab
128 Fingers or transport mountings
129 BOP (blow-out preventer) stack
130 Well

What is claimed is:

1. A drilling machine for exploratory and productive wells, comprising:

a base;

a top drive;

a guide for guiding a movement of the top drive codirectionally with a longitudinal axis of said base;

a gripper for at least one of gripping and guiding a drilling pipe, said gripper being moveable perpendicular to the base axis;

a live ring connected to the base at a foot of said base;

a rig floor, said live ring being affixed to said rig floor;

a drawworks arranged below said rig floor, said drawworks including a cable guiding trolley; and an iron roughneck arranged one of on said rig floor and in a lower region of said base above said rig floor, said iron roughneck being one of slidably moveably mounted and pivotably moveably mounted.

2. A drilling machine according to claim 1, further comprising at least one subframe box supporting said rig floor, said drawworks being arranged in said sub frame box.

3. A drilling machine for exploratory and productive wells, comprising:

a base;

a top drive;

a guide for guiding a movement of the top drive codirectionally with a longitudinal axis of said base;

a gripper for at least one of gripping and guiding a drilling pipe, said gripper being moveable perpendicular to the base axis;

a live ring connected to the base at a foot of said base;

a rig floor, said live ring being affixed to said rig floor; and a pipe handling device arranged proximal at least one of said rig floor and said base, wherein said pipe handling device is arranged below said rig floor.

4. A drilling machine according to claim 3, wherein said pipe handling device comprises:

a truck moveable on rails;

a pipe receiving unit arranged on said truck; and a pivot device, said pipe receiving unit being mounted to said pivot device so as to be at least one of rotatable and pivotable in a vertical plane.

5. A drilling machine according to claim 4, wherein said pipe receiving unit comprises at least one of a pipe gripper and a retaining unit.

6. A drilling machine for exploratory and productive wells, comprising:

a base;

a top drive;

a guide for guiding a movement of the top drive codirectionally with a longitudinal axis of said base;

a gripper for at least one of gripping and guiding a drilling pipe, said gripper being moveable perpendicular to the base axis;

a live ring connected to the base at a foot of said base;

a steel structure, and a locking apparatus arranged on an upper end of said base and connectable to said steel structure.

7. A drilling rig comprising at least two drilling machines, each drilling machine including:

a base;

a top drive;

a guide for guiding a movement of the top drive codirectionally with a longitudinal axis of said base;

a gripper for at least one of gripping and guiding a drilling pipe, said gripper being moveable perpendicular to the base axis; and a live ring connected to the base at a foot of said base, each machine being moveable at least one of rotatably and pivotably for selective positioning of said machines over a center of a well;

said drilling rig further comprising a steel structure arranged between said drilling machines, said drilling machines being reciprocally lockable to said steel structure and said drilling machines being connected to one another by at least one of a cable and a chain, the steel structure carrying a return roller, said at least one of a cable and a chain passing over said roller.

8. A drilling rig according to claim 7, further comprising a damping device arranged on at least one of the steel structure and said drilling machines, the damping device including at least one of a spring and a hydraulic cylinder with a choke.

9. A method for sinking a well and installing pipe work with a drilling machine, said drilling machine having a base, a top drive on the base, a handling device on the base, a gripper in the base for gripping a pipe, an elevator, and a rail-borne pipe handling unit, said method comprising:

a) providing that at least a part of the base is rotatable about a vertical axis, said top drive being located in at least one of an upper and a middle region of said base;

b) rotating said at least a part of the base to a base position proximal a pipe collection point at which a pipe selected from a pipe stock and conveyed to said collection point with said handling unit is held;

c) lowering the top drive and handling device connected thereto, and the elevator on the base sufficiently to enable said elevator to encompass said selected pipe;

d) extending the gripper from the base sufficiently for the gripper to encompass said selected pipe;

e) lifting the pipe on the base and rotating the base to position the pipe over the well; and (f) connecting a lower end of the selected pipe to a pipe located in the well, and connecting an upper end of the selected pipe to a drive shaft of said top drive.

10. The method according to claim 9, wherein connection of the upper end of said selected pipe is with a drive shaft of said top drive and is effected with at least one of a screwing and securing device, and the pipe handling device.

11. The method according to claim 10, wherein connection of the lower end of the selected pipe with a pipe in the well is effected first, and then connection of the upper end of said selected pipe made with the drive shaft of said top drive.

12. The method according to claim 9, wherein connection of the upper end of said selected pipe and said drive shaft of the top drive is effected with at least one of a screwing and securing device, and the pipe handling device.

13. The method according to claim 9, wherein the at least a part of the base which is rotatable is the top drive, said top drive being rotated about a vertical axis parallel to a longitudinal axis of said base to position it proximal said collection point.

14. The method according to claim 9, wherein during pipe handling steps involved in installation and removal operations, the selected pipe is suspended only in the elevator, connection of said selected pipe with the drive shaft of the top drive being omitted.

* * * * *